US008997895B2

(12) United States Patent
Swadi et al.

(10) Patent No.: US 8,997,895 B2
(45) Date of Patent: Apr. 7, 2015

(54) SYSTEM AND METHOD FOR COUPLING AN IMPREGNATED DRILL BIT TO A WHIPSTOCK

(75) Inventors: Shantanu N. Swadi, Cypress, TX (US); Philip M. Gregurek, Pearland, TX (US); Kenneth M. Nevlud, Spring, TX (US); Charles H. Dewey, Houston, TX (US); Michael G. Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 329 days.

(21) Appl. No.: 13/447,188

(22) Filed: Apr. 14, 2012

(65) Prior Publication Data

US 2012/0261193 A1 Oct. 18, 2012

Related U.S. Application Data

(60) Provisional application No. 61/476,013, filed on Apr. 15, 2011.

(51) Int. Cl.
*E21B 7/04* (2006.01)
*E21B 7/06* (2006.01)

(52) U.S. Cl.
CPC ..... *E21B 7/061* (2013.01)

(58) Field of Classification Search
CPC ..... E21B 7/061; E21B 7/04; E21B 7/08; E21B 10/50; E21B 10/60; E21B 12/04; E21B 49/06; E21B 23/01; E21B 23/02; E21B 29/06; E21B 23/00; E21B 10/55
USPC ..... 175/61, 75, 80, 82; 166/117.6, 55.7
See application file for complete search history.

(56) References Cited

U.S. PATENT DOCUMENTS

| | | | |
|---|---|---|---|
| 2,498,159 | A | 2/1944 | Gammill |
| 2,553,874 | A | 5/1951 | Spaulding et al. |
| 4,397,355 | A | 8/1983 | McLamore |
| 4,765,404 | A | 8/1988 | Bailey et al. |
| 5,361,833 | A | 11/1994 | Schock et al. |
| 5,771,972 | A | 6/1998 | Dewey et al. |
| 5,806,596 | A | 9/1998 | Hardy et al. |
| 5,826,651 | A | 10/1998 | Lee et al. |
| 5,878,818 | A | 3/1999 | Hebert et al. |
| 5,887,655 | A | 3/1999 | Haugen et al. |

(Continued)

FOREIGN PATENT DOCUMENTS

WO 2006070204 7/2006

OTHER PUBLICATIONS

USPTO Notice of Allowance in U.S. Appl. No. 13/440,708, mailed Mar. 24, 2014 (5 pages).

(Continued)

*Primary Examiner* — Yong-Suk (Philip) Ro

(57) ABSTRACT

A system and method to facilitate the drilling of one or more lateral wellbores while eliminating one or more trips downhole. The system utilizes a drilling assembly comprising an impregnated drill bit or other suitable drill bit. The impregnated drill bit is coupled to a whipstock by a connector for deployment downhole in a single trip. The connector comprises a separation device which facilitates disconnection of the impregnated drill bit from the whipstock once the whipstock is anchored at a desired downhole location.

27 Claims, 5 Drawing Sheets

(56) References Cited

U.S. PATENT DOCUMENTS

| | | | | |
|---|---|---|---|---|
| 5,887,668 | A | 3/1999 | Haugen et al. | |
| 5,894,889 | A | 4/1999 | Dewey et al. | |
| 6,032,740 | A | 3/2000 | Schnitker et al. | |
| 6,050,334 | A | 4/2000 | McGarian et al. | |
| 6,089,319 | A | 7/2000 | Singleton | |
| 6,102,123 | A | 8/2000 | Bailey et al. | |
| 6,464,002 | B1 | 10/2002 | Hart et al. | |
| 6,581,699 | B1 | 6/2003 | Chen et al. | |
| 6,612,383 | B2 | 9/2003 | Desai et al. | |
| 6,719,045 | B2 | 4/2004 | Hart et al. | |
| 7,020,597 | B2 | 3/2006 | Oliver et al. | |
| 7,178,589 | B2 | 2/2007 | Campbell et al. | |
| 7,178,609 | B2 * | 2/2007 | Hart et al. | 175/61 |
| 7,207,401 | B2 | 4/2007 | Dewey et al. | |
| 7,225,889 | B2 | 6/2007 | Dewey | |
| 7,267,175 | B2 | 9/2007 | Haugen et al. | |
| 7,610,971 | B2 | 11/2009 | Neff | |
| 8,327,944 | B2 | 12/2012 | King et al. | |
| 2001/0035302 | A1 | 11/2001 | Desai et al. | |
| 2002/0195243 | A1 | 12/2002 | Hart et al. | |
| 2004/0089443 | A1 | 5/2004 | Dewey et al. | |
| 2004/0173384 | A1 | 9/2004 | Yong et al. | |
| 2005/0039905 | A1 | 2/2005 | Hart et al. | |
| 2007/0044954 | A1 | 3/2007 | Dewey | |
| 2008/0302575 | A1 | 12/2008 | Durairajan et al. | |
| 2009/0133877 | A1 | 5/2009 | Neff | |
| 2010/0018777 | A1 | 1/2010 | Pessier et al. | |
| 2010/0032155 | A1 | 2/2010 | Darnell et al. | |
| 2011/0155468 | A1 | 6/2011 | Gregurek et al. | |
| 2011/0209922 | A1 * | 9/2011 | King et al. | 175/402 |
| 2012/0222902 | A1 | 9/2012 | Alsup et al. | |
| 2012/0255785 | A1 | 10/2012 | Gregurek et al. | |

OTHER PUBLICATIONS

International Search Report and Written Opinion of PCT Application No. PCT/US2012/027322 dated Sep. 25, 2012: pp. 1-18.
International Search Report and Written Opinion of PCT Application No. PCT/US2012/032389 dated Oct. 29, 2012: pp. 1-12.
International Search Report and Written Opinion of PCT Application No. PCT/US2012/033700 dated Jan. 14, 2013: pp. 1-12.
Dewey et al., "SPE 138001: High Performance Wellbore Departure and Drilling System for Accessing New Target," SPE International, 2011: pp. 1-9.

* cited by examiner

SYSTEM AND METHOD FOR COUPLING AN IMPREGNATED DRILL BIT TO A WHIPSTOCK

CROSS-REFERENCE TO RELATED APPLICATION

The present document is based on and claims priority to U.S. Provisional Patent Application Ser. No. 61/476,013, filed on Apr. 15, 2011, the disclosure of which is incorporated by reference herein in its entirety.

BACKGROUND

Directional drilling has proven useful in facilitating the production of formation fluid, e.g., hydrocarbon-based fluid, from a variety of reservoirs. In application, a vertical wellbore is drilled, and directional drilling is employed to create one or more deviated or lateral wellbores extending outwardly from the vertical wellbore. Often, a whipstock is employed to facilitate the drilling of the one or more lateral wellbores in a method referred to as sidetracking.

If the formation being drilled is hard or formed of abrasive rock, diamond impregnated drill bits are used. The cuffing face of diamond impregnated drill bits include diamonds, e.g., natural or synthetic diamonds, which are distributed through a supporting material, sometimes referred to as matrix material. The distributed diamonds form an abrasive layer, and during operation of the drill bit, the diamonds within the abrasive layer become exposed as the supporting material wears away. As the supporting material continues to be worn away, new diamonds are exposed to enable long-term cutting capability for the diamond impregnated drill bit.

To facilitate directional drilling with an impregnated drill bit, the whipstock is used to guide the drill bit in a lateral direction to establish a lateral or deviated wellbore branching from the existing substantially vertical wellbore. Whipstocks are designed with a face, or ramp surface, oriented to guide the drill bit in the desired lateral direction. The whipstock is positioned at a desired depth in the wellbore and its face oriented to facilitate directional drilling, i.e., sidetracking, of the lateral wellbore along the desired drill path. In many applications, sidetracking requires at least two trips downhole. In an initial trip, a short multi-ramp whipstock is delivered downhole, oriented and set at the desired wellbore location. A bi-mill is then used in conjunction with the short multi-ramp whipstock to enable drilling of a few feet of rat hole. The bi-mill is then tripped out of the wellbore. In a subsequent trip, a drilling bottom hole assembly, with an impregnated drill bit and a turbodrill, is tripped downhole to complete the drilling of the lateral wellbore. However, each trip downhole beyond the initial trip increases both the time and costs associated with the drilling operation.

SUMMARY

A system and method which facilitate the drilling of one or more lateral wellbores, e.g., by eliminating one or more trips downhole, are disclosed. In one or more embodiments, the system and method utilize a drilling assembly comprising an impregnated drill bit, a whipstock and a connector coupled therebetween. The impregnated drill bit has a body and a plurality of cutting surfaces or blades separated by junk slots or channels. At least a portion of the impregnated drill bit is of a diamond impregnated material. The impregnated drill bit is coupled to a whipstock by a connector which may be coupled directly to the impregnated drill bit or indirectly to the impregnated drill bit via a turbine sleeve. The connector includes a separation device which facilitates decoupling of the impregnated drill bit from the whipstock once the whipstock is anchored downhole at a desired location.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
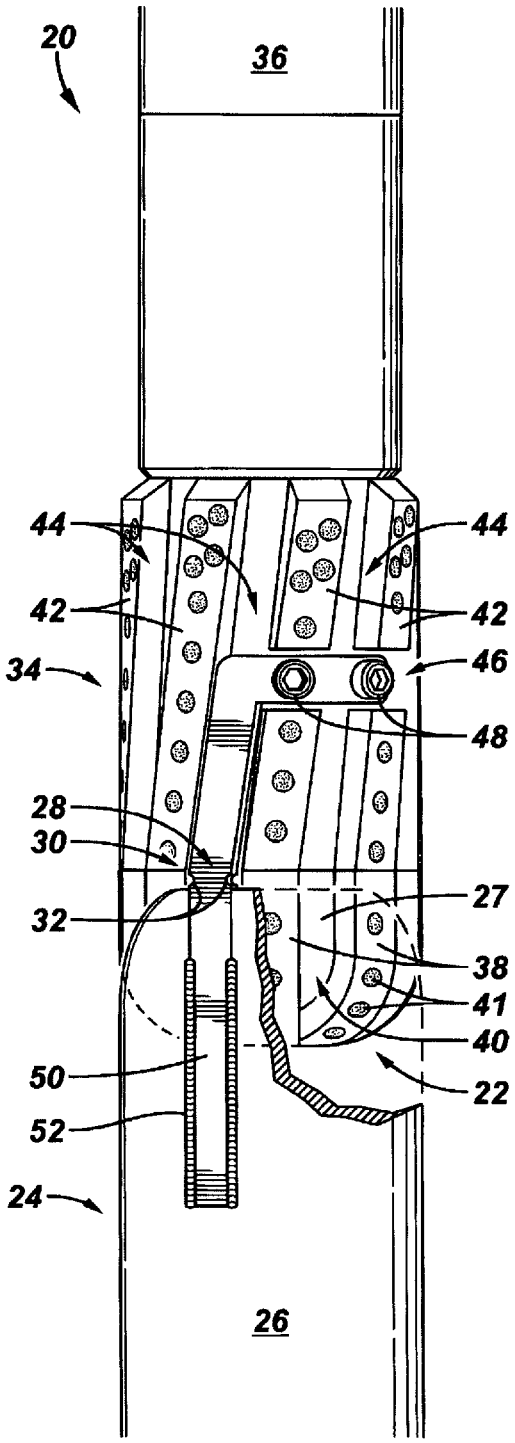
FIG. 1 is an illustration of one example of a lateral wellbore drilling system comprising a whipstock assembly coupled to an impregnated drill bit by a connector, according to an embodiment of the present disclosure.

In the following description, numerous details are set forth to provide an understanding of one or more embodiments of the invention. However, it will be understood by those of ordinary skill in the art that the one or more disclosed embodiments may be practiced without these details and that numerous variations or modifications from the disclosed embodiments may be possible.

The present disclosure generally relates to a system and method to facilitate the drilling of a lateral wellbore, i.e., sidetracking, by eliminating one or more downhole trips. By way of example, and not limitation, the sidetracking operation may be performed with respect to an open wellbore (i.e., non-cased portion of the wellbore) to create a lateral bore extending from the open wellbore. However, one or more embodiments of the present disclosure may also be utilized in cased hole sidetracking operations.

The system and method combine an impregnated drill bit, e.g., a diamond impregnated drill bit, with a whipstock assembly for deployment in a single downhole trip. While an impregnated drill bit is disclosed in one or more embodiments herein, a hybrid drill bit or matrix drill bit (e.g., without impregnation) may be equally employed, as will be readily understood by those skilled in the art. In one or more embodiments, the whipstock is coupled to the impregnated drill bit via a connector. The connector may be arranged and designed such that the whipstock of the whipstock assembly couples to the impregnated drill bit, or to a turbine sleeve, which is in turn coupled to the impregnated drill bit. The connector may also have a separation mechanism or device, which facilitates separation of the impregnated drill bit from the whipstock of the whipstock assembly once the whipstock assembly is positioned and anchored at the desired downhole location.

In one or more embodiments, the system comprises an impregnated drill bit coupled with a turbine sleeve which is tripped downhole with a turbine or turbodrill to facilitate sidetracking. The whipstock assembly is coupled to the impregnated drill bit through the turbine sleeve via a connector. The impregnated drill bit may be constructed with a support body of tungsten carbide, steel or other material known to those skilled in the art. The cutting surfaces, i.e., blades, of the impregnated drill bit may be constructed with a diamond impregnated matrix material. The turbine sleeve may be coupled to the impregnated drill bit in any known manner including, for example, welding. Additionally, the connector may be designed to fit partially or entirely within grooves, e.g., junk slots or channels, positioned on the impregnated drill bit and on the turbine sleeve. In one or more embodiments, the connector may also be designed to fit specific drill bits, e.g., known impregnated drill bit geometries. Such specificity is based on the blade count and/or corresponding junk slots/channels, which can vary from one drill bit to another. In these embodiments, the connector does not require any changes to the cutting structure/design of the impregnated drill bit itself. As will be disclosed hereinafter, the impregnated drill bit may be designed to provide a desired area along a junk slot or other surface thereof to accommodate a connector of a desired size and/or strength.

In one or more other embodiments, the connector is coupled between the whipstock of the whipstock assembly and a surface of the impregnated drill bit, i.e., a direct or semi-direct connection. As with other embodiments, the cutting surfaces, i.e., blades, of the impregnated bit may be constructed with a diamond impregnated matrix material. Also, the impregnated drill bit may be constructed with a support body of tungsten carbide, steel or other material known to those skilled in the art. As will be disclosed in greater detail herein, the support body may be specifically designed, e.g., with a desired profile or construction, to facilitate coupling between the connector and the impregnated drill bit. In such embodiments, the material of construction and its configuration are selected to provide sufficient strength to withstand the loads, e.g., tensile loads, encountered when shearing the connector or otherwise separating the impregnated drill bit from the whipstock assembly.

In the embodiments described above, the connector may be coupled to a upper end portion of a whipstock, which forms part of the whipstock assembly. For example, a lower end portion of the connector may be welded to an upper end portion of the whipstock. In one or more embodiments, the drill bit may be coupled to a bit motor or a turbine, e.g., via a threaded connection, prior to coupling of the connector.

The separation mechanism/device of the connector facilitates separation of upper and lower portions of the connector once the whipstock assembly is anchored or secured at the desired downhole location. By way of example, and not limitation, the separation mechanism or device may be a shear member, such as a shear bolt, which fastens two portions of the connector together. The separation mechanism or device may also be a shear portion/region, which is designed to shear upon application of a predetermined loading/force to the connector. Such shear portion/region may be a groove or notch disposed in a surface of the connector. After shearing, an upper portion of the connector remains coupled to the impregnated drill bit (i.e., within one or more junk slots or channels), which reduces the amount of shrapnel that would otherwise be milled by the impregnated drill bit during initial sidetracking operations.

Referring generally to FIG. 1, an embodiment of a lateral wellbore drilling string system/assembly 20 is illustrated and comprises an impregnated drill bit 22 coupled to a whipstock assembly 24 having a whipstock 26. The impregnated drill bit 22 may comprise a body 27 constructed of, e.g., tungsten carbide and cutting surfaces (or blades) 38 constructed of, e.g., a diamond impregnated matrix material. The impregnated drill bit 22 is coupled to the whipstock assembly 24 with a connector 28. In the embodiment illustrated in FIG. 1, the connector 28 is coupled to impregnated drill bit 22 via a turbine sleeve 34 which may be part of a turbine system, e.g., a turbodrill system, comprising a turbine 36, e.g., a turbodrill. The connector 28 comprises a longitudinal member 50 that extends between turbine sleeve 34 (coupled to impregnated drill bit 22) and the whipstock 26 of the whipstock assembly 24. The connector 28 also comprises a separation mechanism or device 30, e.g., a shear portion/region, designed to enable separation of the impregnated drill bit 22 from the whipstock assembly 24 when the whipstock assembly 24 is positioned and anchored at a desired location within a wellbore (e.g., an encased portion thereof). By way of example, the separation mechanism/device 30 may be a groove or notch 32 disposed in the connector 28 and positioned to enable separation of upper and lower portions of the connector 28 upon application of a force or loading upon the connector 28, e.g., by pulling up on the drill string coupled to connector 28 after whipstock assembly 24 is anchored.

Lateral wellbore drilling system/assembly 20 may also comprise other components of a bottomhole assembly depending on the specifics of the drilling application. Examples of other bottomhole assembly components that may be coupled to the drill string above impregnated drill bit 22 include directional drilling and measurement equipment. While not shown in FIG. 1, such directional drilling equipment may comprise a steerable drilling assembly which may include a bent angle housing to direct the angle of drilling (i.e., directionally control the drilling) during drilling of the lateral wellbore. The directional drilling equipment may alternatively employ other directional control systems including, but not limited to, push-the-bit or point-the-bit rotary steerable systems. A variety of other features and components also known to those skilled in the art may be incorporated into lateral wellbore drilling system/assembly 20, including measurement-while-drilling and logging-while-drilling equipment.

Depending on the specific sidetracking operation to be performed, the whipstock assembly 24 may comprise a variety of components to facilitate anchoring of the whipstock 26 and guiding of the impregnated drill bit 22 during drilling of a lateral wellbore. By way of example, the whipstock assembly 24 may include a setting assembly (not shown) which facilitates the engagement of the whipstock 26 with a sidewall of the wellbore (not shown) when locating the whipstock 26 of the whipstock assembly 24 at a desired location within the wellbore. The setting assembly may utilize an anchor (not shown) having a relatively large ratio of expanded diameter to unexpanded diameter to facilitate anchor engagement with the wellbore sidewall. The anchor may employ a plurality of slips which are expandable between a running position (unexpanded) and an anchoring position (expanded). In at least some embodiments, the slips are hydraulically set by directing high pressure, hydraulic actuating fluid along a suitable passageway or conduit in or along the whipstock 26. Nevertheless, the setting assembly may utilize other systems/devices known to those skilled in the art to secure the whipstock 26 of the whipstock assembly 24 in the wellbore.

According to one embodiment, the lateral wellbore drilling system/assembly 20 is conveyed downhole to a desired location and rotated to the desired orientation in which to drill the lateral wellbore/borehole. Hydraulic fluid is then delivered downhole via a passageway 64 and/or a conduit 68 (see FIG. 2) through the impregnated drill bit 22 and along the whipstock 26 to the anchor. The hydraulic fluid applies hydraulic pressure to set the anchor slips against the surrounding wellbore sidewall, thereby securing the whipstock 26 at the desired wellbore location and orientation. An upward force may then be applied to impregnated drill bit 22 (and coupled connector 28) via the drill string, or the impregnated drill bit 22 may be rotated or otherwise loaded to separate connector 28 at the separation device/mechanism 30. Upon separation from whipstock 26, the drill bit 22 may be moved along a ramp portion or face of the whipstock 26, which is arranged and designed to guide the impregnated drill bit 22 into the sidewall of the openhole for at least partial drilling of the lateral wellbore.

With additional reference to FIG. 1, the illustrated impregnated drill bit 22 may comprise body 27 formed of tungsten carbide or other material, e.g., steel, other carbide material, etc., and cutting surfaces 38 with a diamond impregnated matrix material. As shown, impregnated drill bit 22 has a plurality of cutting surfaces or blades 38 separated by grooves, i.e., junk slots or channels 40. A plurality of cutting elements 41 may be mounted to blades 38 or to other regions of impregnated drill bit 22. By way of example, the cutting elements 41 may comprise polycrystalline diamond compact cutters, grit hot pressured insert cutters or thermally stable polycrystalline diamond cutters. The turbine sleeve 34 also may comprise a plurality of radially expanded regions 42 separated by grooves, i.e., junk slots or channels 44. The connector 28 may be designed with a longitudinal portion 50 sized to fit within the bit junk slots 40 and the turbine sleeve junk slots 44. The impregnated drill bit 22 and turbine sleeve 34 may also be designed specifically to accommodate a connector 28 of a desired size, shape, and strength.

Figure 2:
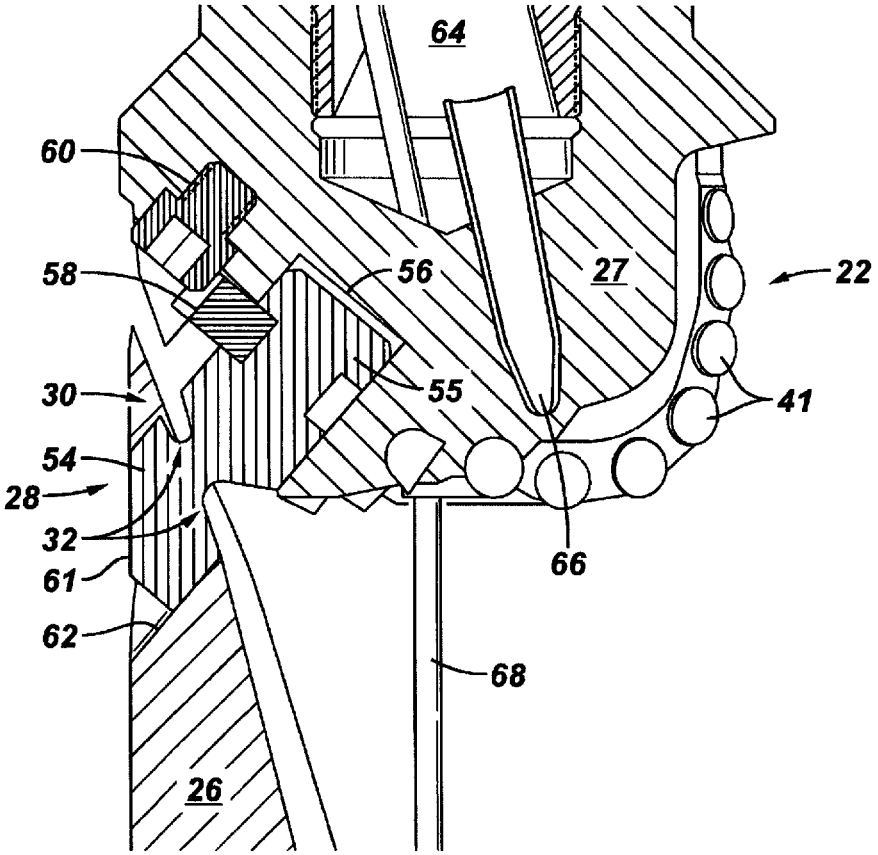
FIG. 2 is a cross-sectional view of another example of a lateral wellbore drilling system, according to an embodiment of the present disclosure.

In one or more embodiments, and as best shown in FIG. 2, impregnated drill bit 22 may be designed with a central, internal flow path 64 through which drilling fluid is directed downwardly through the impregnated drill bit 22 and then out through nozzles 66 to help remove cuttings during drilling. In some embodiments, the impregnated drill bit 22 also may comprise one or more secondary flow passages 68 through which hydraulic actuating fluid may be delivered downhole to actuate downhole tools, such as anchor slips of the whipstock assembly 24. In this latter design, the secondary flow passage 68 may be blocked by one or more flow blocking members 80, e.g., a burst disc, (FIG. 4) prior to separation of the impregnated drill bit 22 and the whipstock assembly 24. In some embodiments, separate burst discs (not shown) may be used to block the primary internal flow path 64 and the secondary flow passage 68 to enable, for example, actuation of the anchor slips prior to allowing flow of drilling fluid down through the primary internal flow path 64.

In the embodiment illustrated in FIG. 1, connector 28 is connected to impregnated drill bit 22 via a fastener 46. By way of example, fastener 46 may comprise one or more threaded fasteners 48 which extend through an upper end portion of connector 28 for threaded engagement with corresponding threaded openings in turbine sleeve 34. However, a variety of fasteners 46 or similar mechanisms may be employed to secure connector 28 to the turbine sleeve 34.

As previously disclosed, connector 28 has a longitudinal member 50 which includes the separation mechanism 30, e.g., shear region 32, disposed between an upper portion and a lower portion of the longitudinal member 50. The separation mechanism 30 is positioned just above the top end portion of whipstock 26 to minimize exposure while sidetracking. Thus, the separation mechanism/device 30 may be positioned and designed to shear generally flush or nearly flush with the top end portion of the whipstock 26 so as to leave minimal, if any, protrusion of the remaining lower portion of longitudinal member 50 above the top end portion of whipstock 26 after shearing. The lower portion of the longitudinal member 50 is secured to an upper end portion, e.g., the back, of whipstock 26. By way of example, the lower end portion of longitudinal member 50 may be secured to the upper end portion of the whipstock 26 by a suitable fastener 52. According to one embodiment, the lower portion of longitudinal member 50 is welded to the upper end portion of whipstock 26 such that the weldment serves as fastener 52. The upper portion of longitudinal member 50, which is coupled to turbine sleeve 34, may remain with the turbine sleeve 34 and the impregnated drill bit during the sidetracking drilling operation, e.g., disposed partially or fully within grooves/junk slots or channels 40, 44.

Figure 3:
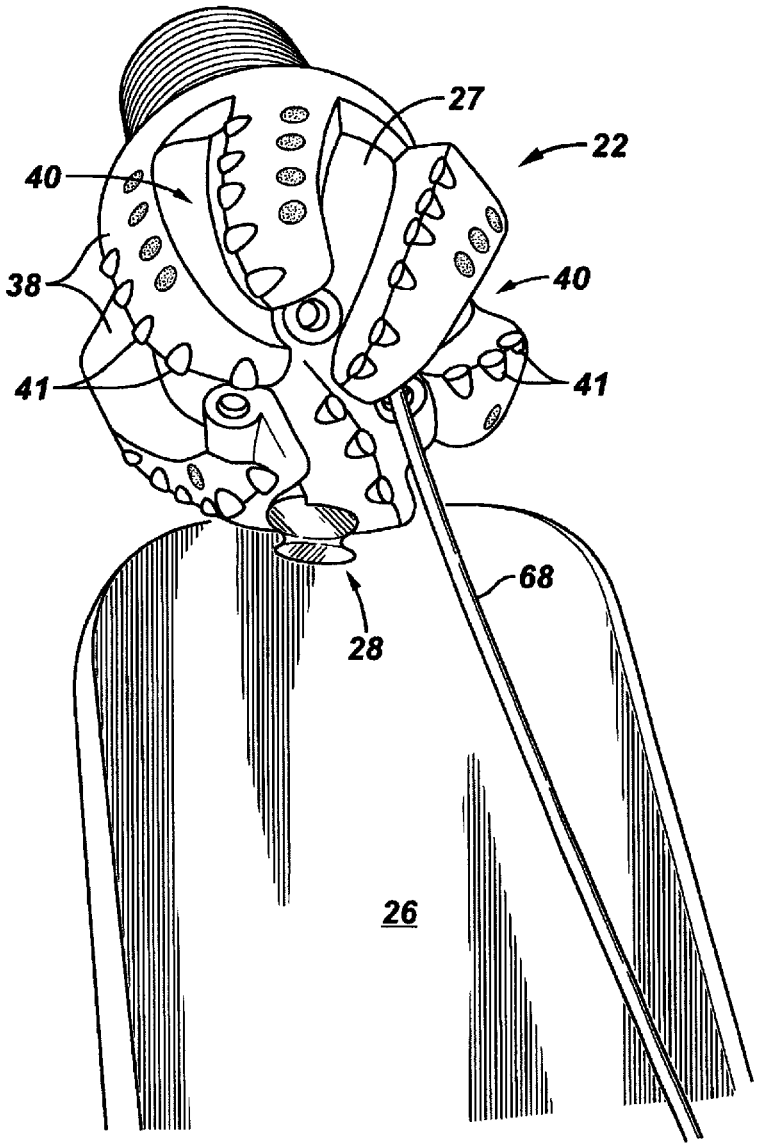
FIG. 3 is an orthogonal view of the lateral wellbore drilling system illustrated in FIG. 2, according to an embodiment of the present disclosure.

In another embodiment of the present disclosure, as illustrated in FIGS. 2 and 3, connector 28 is coupled to impregnated drill bit 22 without turbine sleeve 34. Connector 28 is in the form of a break bolt or pin 54 having a separation mechanism/device 30. Separation mechanism/device 30 may be in the form of a shear region/portion, e.g., a groove or notch 32, located proximate a top end portion of the whipstock 26. An upper portion or body 55 of the pin 54 is received in a recess 56 formed in the matrix material of body 27 of impregnated drill bit 22. The pin 54 may be secured within the recess 56 by a retainer 58, such as a removable retainer plate held in place by a removable fastener 60. Recess 56 may be positioned in a blade 38 of impregnated drill bit 22 that is slightly offset from the other blades 38 (i.e., recessed from the outermost radial extent of the other blades). The embodiment illustrated in FIGS. 2 and 3 may employ a positive displacement motor rather than a turbine to rotate impregnated drill bit 22. A lower portion or head 61 of the pin 54 is received and secured in an opening 62 formed in whipstock 26. By way of example, and not limitation, the pin 54 may be welded in opening 62, although other fastening techniques may be employed. The separation mechanism/device 30 may be positioned in connector 28 and designed to shear generally flush or nearly flush with the face of the whipstock 26 so as to leave minimal, if any, protrusion of the remaining lower portion of longitudinal member 50 of connector 28 from the face of whipstock 26 after shearing. As will be disclosed in greater detail hereinafter, the impregnated drill bit 22 surrounding the recess 56 is formed from a material strong enough to withstand the loading, e.g., tensile loading, encountered in shearing off the break bolt/pin 54 via shearing through shear region 32.

The configuration of impregnated drill bit 22 may change depending on the specific drilling applications for which it is designed. In the embodiment illustrated in FIGS. 2 and 3, impregnated drill bit 22 comprises a central, internal flow passage 64 which may be employed to direct drilling fluid through nozzles 66 to remove cuttings during drilling. The impregnated drill bit 22 also may comprise or work in cooperation with secondary flow passages 68, which direct hydraulic actuating fluid downhole to specific tools, e.g., to hydraulically actuated anchor slips of a whipstock assembly anchor.

Figure 4:
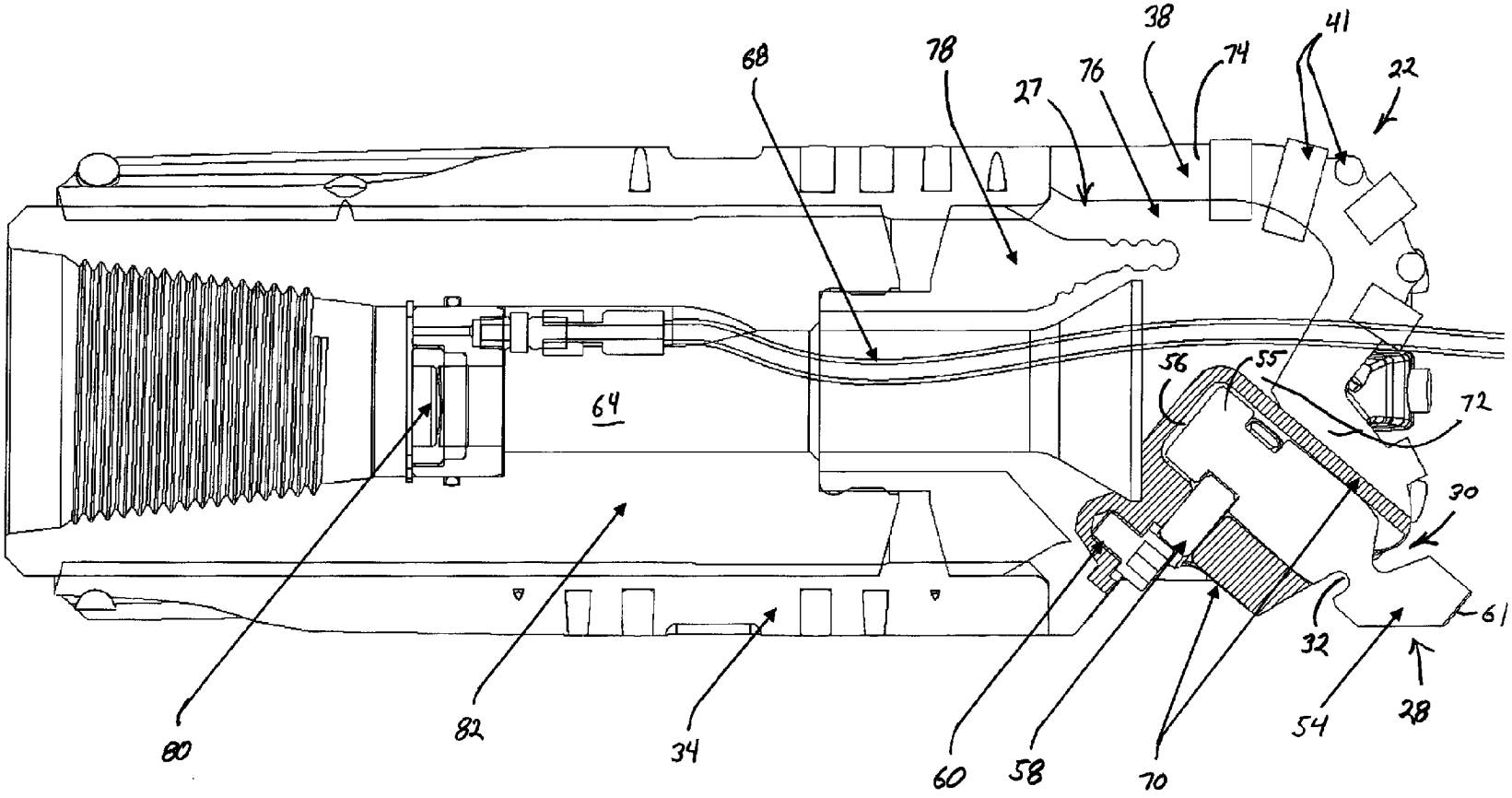
FIG. 4 is an example of the coupling between the connector and the impregnated drill bit, according to an embodiment of the present disclosure.

Referring generally to FIG. 4, another embodiment of impregnated drill bit 22 is illustrated in greater detail. In this embodiment, the impregnated drill bit 22 is a diamond impregnated drill bit, or another type of matrix bit formed at least in part by impregnated and/or matrix material. By way of example, the impregnated drill bit 22 may be formed as a composite of different materials. According to one embodiment, the impregnated drill bit 22 comprises a tougher material 70 positioned to counteract contact stresses exerted by connector 28, e.g., pin 54, against the impregnated drill bit 22 during deployment of and/or separation from whipstock 26. The material 70 is tougher, e.g., harder or stronger, relative to a surrounding material 72 of the drill bit 22.

The tougher, e.g., harder, material 70 may be positioned along recess 56 into which pin 54 is received. By way of example, and not limitation, the tougher material 70 may be positioned radially inward relative to the surrounding material 72 along recess 56, e.g., recess 56 may be lined with the tougher material 70. In some embodiments, the material 70 is secured in place during formation of the drill bit 22. For example, the material 70 may comprise a metal material and the surrounding material 72 may comprise a metal carbide material held together by a binder used during formation, e.g., molding or casting, of the drill bit 22. The tougher material 70 may be thermally fused or otherwise fused with the surrounding material 72 during formation of the impregnated drill bit 22. However, the tougher material 70 may be formed as a separate component, e.g., a sleeve, which is brazed, adhered, secured by casting or otherwise secured at the desired location in impregnated drill bit 22.

Depending on the drilling application for which it is designed, the composite, impregnated drill bit 22 may comprise a variety of materials. By way of example, the material 70 that surrounds recess 56 may be a metal material, such as tungsten, steel, or another suitable metal. Depending on its properties, the material 70 may initially be in a powdered form prior to formation, e.g., molding, of drill bit 22. The surrounding material 72 may comprise a variety of materials or combinations of materials. For example, surrounding material 72 may comprise a metal carbide, such as tungsten carbide, and/or an impregnated material, such as a diamond impregnated material. In the embodiment illustrated, the blades 38 may be formed from an impregnated material 74, e.g., a diamond impregnated material, which may be molded from a suitable diamond premix. Also in this embodiment, the body 27 or portions of the body 27 may be formed from a metal carbide material 76, such as a tungsten carbide material.

In some embodiments, other portions of the impregnated drill bit 22 may comprise other materials, such as a steel blank section 78. However, the various materials are provided as examples and the specific types of materials and/or combinations of materials may change from one drilling application to another. In any of these embodiments, the tougher material 70 positioned in the impregnated drill bit 22 around the connector 28 prevents the potentially detrimental effects of contact stresses incurred during deployment of and/or separation from the whipstock 26.

The drill bit 22 and the related components designed to facilitate deployment of whipstock 26 may be adjusted according to the parameters of a given deployment operation. In the embodiment illustrated, for example, the secondary flow passage 68, e.g., a hydraulic conduit or hose, is deployed through drill bit 22 along central flow passage 64. During deployment, the central flow passage 64 may be blocked by a suitable blocking member 80, e.g., a burst disc, which may be positioned in an upper section 82 of the drill bit. The blocking member 80 is designed to prevent flow of fluid along passage 64 during deployment and setting of the whipstock 26.

Figure 5:
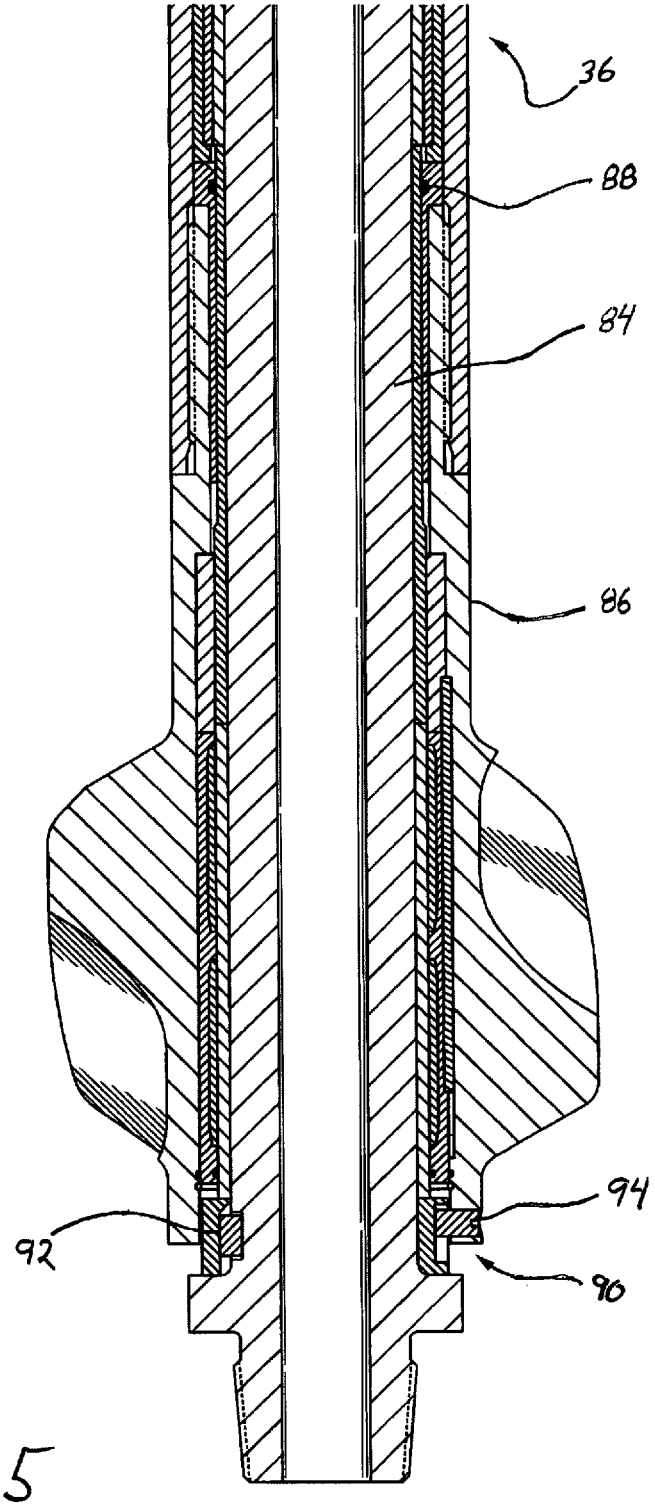
FIG. 5 is a cross-sectional view of a mechanism used to block a turbodrill against rotation during setting of a whipstock assembly, according to an embodiment of the present disclosure.

In any of the embodiments described above with respect to FIGS. 2-4, the impregnated drill bit 22 may be combined with a turbine sleeve 34 (FIG. 1) which is part of turbine assembly 36 (FIG. 1). In at least one or more such embodiments, the turbine 36 is locked from rotation during the whipstock deployment and setting process. As best illustrated in FIG. 5, the turbine 36 may comprise a hollow shaft 84 which is rotatably sealed within a surrounding housing 86 by a seal 88. During downhole deployment and setting of the whipstock 26, the hollow shaft 84 is locked with respect to the housing 86 by a locking arrangement 90, such as a locking key 92 and/or shear member/pin 94. Once the whipstock 26 is set and the impregnated drill bit 22 is sheared or otherwise released from the whipstock 26 via separation mechanism/device 30, a flow rate is increased through the turbine 36 to increase the turbine output torque, thereby releasing locking arrangement 90, e.g., by shearing locking key 92 and/or shear member/pin 94. Once released, impregnated drill bit 22 can be rotated, and the sidetracking operation may be commenced after properly orienting the drilling assembly away from the whip face of the whipstock 26, as is well known to those skilled in the art.

The drilling system/assembly 20 (FIGS. 1-2) may incorporate a variety of components to facilitate a given sidetracking operation. Additionally, the configuration of components and the materials selected for specific components may vary from one drilling application to another. For example, whipstock 26 may be designed with a single, straight ramp suited for open hole applications. The drilling system/assembly 20 may also be arranged with a bottom hole assembly designed for sidetracking and thus having one or more of the following components: an expandable anchor, an open hole whipstock, an impregnated drill bit adapted for hookup to the whipstock assembly, a locked turbine/turbodrill, a positive displacement motor, a running tool, a plurality of bypass valves, and/or other components designed to facilitate the sidetracking operation. In at least one embodiment disclosed herein, the impregnated drill bit 22 is coupled to the whipstock assembly 24 during downhole deployment. This enables the drilling system/assembly 20 to at least partially complete the sidetracking/drilling operation in a single trip downhole.

In operation, the drilling system/assembly 20 is tripped downhole with the whipstock assembly 24 secured to the impregnated drill bit 22 via connector 28. In a variety of drilling applications, the drilling assembly 20 and the whipstock assembly 24 are delivered downhole into a wellbore that is open and thus not lined with a casing. Once at the desired downhole wellbore location, the whipstock 26 is oriented. By way of example, the whipstock 26 may be oriented with the aid of a measurement-while-drilling/gyro system. The whipstock 26 is then set by anchoring the whipstock assembly 24 via, for example, an expandable slip style anchor. After setting the whipstock 26, the impregnated drill bit 22 is released, e.g., sheared, from the whipstock assembly 24 by separating, e.g., shearing, the connector 28 via separation mechanism/device 30. The drilling assembly 20 may be disengaged or released from the whipstock 26 by pulling on the drilling assembly 20 to shear the connector 28 via separation mechanism/device 30 at shear region 32. If employed in the system/assembly 20, the turbodrill 36 or bit motor (e.g., positive displacement motor) may be unlocked, and a bent housing of the drilling system/assembly 20 may be oriented to point the impregnated drill bit 22 away from the whip face of the whipstock 26. The impregnated drill bit 22 is then operated to perform the directional drilling operation, i.e., sidetracking, in which a lateral wellbore is at least partially formed along a desired path to a target destination.

In this disclosure, several embodiments have been described in detail. However, those of ordinary skill in the art will readily appreciate that many modifications are possible without materially departing from the teachings of this disclosure. Accordingly, such modifications are intended to be included within the scope of this invention.

What is claimed is:

1. A system for facilitating drilling a sidetracked wellbore, comprising:

an impregnated drill bit comprising a body and a plurality of cutting surfaces separated by junk slots, at least a portion of the impregnated drill bit comprising diamond impregnated material;

a whipstock; and a connector coupling the whipstock to the impregnated drill bit, the connector comprising a separation device to facilitate disengagement of the impregnated drill bit from the whipstock after the whipstock is anchored at a desired downhole location, wherein the impregnated drill bit comprises a recess for receiving the connector, the recess being lined with a tougher material relative to a surrounding material of the impregnated drill bit.

2. The system as recited in claim 1, wherein the tougher material comprises tungsten and the surrounding material comprises tungsten carbide.

3. The system as recited in claim 1, wherein the tougher material comprises steel.

4. The system as recited in claim 1, wherein the tougher material is fused with the surrounding material during formation of the impregnated drill bit.

5. The system as recited in claim 1, wherein the tougher material is in the form of a sleeve affixed in the recess of the impregnated drill bit.

6. The system as recited in claim 1, further comprising a turbine including a turbine sleeve coupled to the impregnated drill bit.

7. The system as recited in claim 6, wherein the turbine sleeve is welded to the impregnated drill bit.

8. The system as recited in claim 6, wherein the turbine is rotatably locked until the whipstock is anchored at the desired downhole location.

9. The system as recited in claim 1, wherein the impregnated drill bit also has one or more cutting elements including one or more polycrystalline diamond cutters.

10. The system as recited in claim 1, wherein the separation device is located proximate a top end portion of the whipstock.

11. The system as recited in claim 1, wherein the connector is welded to the whipstock.

12. A system for drilling a wellbore, comprising:

a drill bit formed as a composite drill bit and comprising a body, cutting elements, a plurality of blades, and a whipstock connector recess sized to receive a whipstock connector pin, the whipstock connector recess being bounded by a radially inward portion formed of a tougher material than a surrounding material of the drill bit;

a whipstock; and the whipstock connector pin coupling the whipstock to the composite drill bit, the whipstock connector pin comprising a shear region to facilitate disengagement of the drill bit from the whipstock once the whipstock is anchored at a desired location.

13. The system as recited in claim 12, wherein the drill bit comprises a diamond impregnated material.

14. The system as recited in claim 12, wherein the drill bit comprises a matrix material.

15. The system as recited in claim 12, wherein the whipstock connector pin comprises a head which extends into an opening formed in an upper end of the whipstock, the head being welded into the opening.

16. The system as recited in claim 12, wherein the whipstock connector pin is held within the whipstock connector recess of the composite drill bit by a removable retainer.

17. The system as recited in claim 16, wherein the removable retainer is held in place by a removable fastener.

18. The system as recited in claim 12, wherein the cutting elements comprise polycrystalline diamond cutters.

19. The system as recited in claim 12, wherein the radially inward portion comprises a primarily metal material and the surrounding material comprises a metal carbide material.

20. The system as recited in claim 12, wherein the radially inward portion comprises a primarily tungsten material and the surrounding material comprises a tungsten carbide material.

21. The system as recited in claim 12, wherein the blades are formed from a diamond impregnated material.

22. A method to facilitate drilling a sidetracked wellbore, comprising:

coupling an impregnated drill bit of a drilling assembly to a whipstock via a connector;

locking a turbine of the drilling assembly from rotation with a locking member;

deploying the drilling assembly and the whipstock in a wellbore;

anchoring the whipstock at a desired location;

disengaging the drilling assembly from the whipstock by separating a separable portion of the connector;

shearing the locking member to allow rotation of the turbine; and commencing drilling a sidetracked wellbore with the drilling assembly.

23. The method as recited in claim 22, wherein the deploying, anchoring, disengaging, shearing and commencing are performed in a single trip downhole.

24. The method as recited in claim 22, further comprising positioning an end portion of the connector in a recess of the impregnated drill bit, and protecting the drill bit from detrimental contact stresses by lining the recess with a tougher material than a surrounding drill bit material.

25. The method as recited in claim 22, wherein coupling the impregnated drill bit of the drilling assembly to the whipstock comprises coupling the connector to a turbine sleeve of the turbine.

26. The method as recited in claim 22, wherein coupling the impregnated drill bit of the drilling assembly comprises coupling the impregnated drill bit to the whipstock with the connector in the form of a pin.

27. The method as recited in claim 22, wherein the separable portion of the connector is positioned proximate a top end portion of the whipstock.

* * * * *